US007553878B2

(12) United States Patent
Parker et al.

(10) Patent No.: US 7,553,878 B2
(45) Date of Patent: Jun. 30, 2009

(54) SPRAY ATOMIZATION

(75) Inventors: Wiley L. Parker, Conroe, TX (US); Collin W. Cross, Houston, TX (US); Alan E. Goliaszewski, Woodland, TX (US)

(73) Assignee: General Electric Company, Fairfield, CT (US)

( * ) Notice: Subject to any disclaimer, the term of this patent is extended or adjusted under 35 U.S.C. 154(b) by 207 days.

(21) Appl. No.: 10/425,153

(22) Filed: Apr. 29, 2003

(65) Prior Publication Data

US 2004/0220284 A1 Nov. 4, 2004

(51) Int. Cl.
*B01F 3/08* (2006.01)
*C10G 11/18* (2006.01)
*C10G 9/36* (2006.01)

(52) U.S. Cl. ..... 516/27; 516/28; 516/30; 208/125; 208/130; 208/153; 208/157

(58) Field of Classification Search ..... 516/27, 516/28, 30; 208/125, 130, 153, 157
See application file for complete search history.

(56) References Cited

U.S. PATENT DOCUMENTS

| | | | | | |
|---|---|---|---|---|---|
| 2,698,284 | A | * | 12/1954 | Adams | 208/157 |
| 3,672,853 | A | | 6/1972 | Reman et al. | 44/281 |
| 3,781,226 | A | * | 12/1973 | Schwartz | 502/62 |
| 3,977,472 | A | * | 8/1976 | Graham et al. | 166/283 |
| 4,405,445 | A | | 9/1983 | Kovach et al. | 208/120.2 |
| 4,483,765 | A | | 11/1984 | Payne | 208/120.2 |
| 4,786,401 | A | * | 11/1988 | Jacob et al. | 208/85 |
| 5,283,001 | A | * | 2/1994 | Gregoli et al. | 516/67 |
| 5,306,418 | A | | 4/1994 | Dou et al. | 208/157 |
| 6,368,367 | B1 | | 4/2002 | Langer et al. | 44/301 |
| 2003/0138373 | A1 | * | 7/2003 | Graham et al. | 423/650 |

FOREIGN PATENT DOCUMENTS

| | | |
|---|---|---|
| EP | 0 367 872 | 5/1990 |

OTHER PUBLICATIONS

Yang et al, "Effect of Emulsified Stock on Product Distribution of FCC", Abstract 75 from American Chemical Society Division of Industrial & Engineering Chemistry, 223rd ACS National Meeting, Orlando FL (Apr. 7-11, 2002).*

(Continued)

*Primary Examiner*—Daniel S Metzmaier
(74) *Attorney, Agent, or Firm*—Hoffmann & Baron, LLP

(57) ABSTRACT

The present invention provides a feedstock composition for increasing the efficiency of atomization in hydrocarbon processing that includes a water-in-hydrocarbon oil emulsion including a non-ionic surfactant capable of stabilizing the emulsion and having a hydrophilic-lipophilic balance of greater than about 12. The emulsion includes water droplets of about 5 to about 10 microns in diameter, the droplets being dispersed substantially uniformly in the hydrocarbon oil phase. These surfactants are capable of stabilizing the water-in-hydrocarbon oil emulsion under relevant temperature and pressure conditions for hydrocarbon processing. The inventive feedstock composition provides a metastable water-in-oil emulsion where expanding water vapor explodes under spray conditions where the system pressure is released, demolishing a larger oil droplet and producing smaller oil droplets.

9 Claims, 1 Drawing Sheet

OTHER PUBLICATIONS

Kirk-Othmer Encyclopedia of Chemical Technology, 4th Ed, vol. 9, 1994, month unknown, pp. 393-413, John-Wiley & Sons (NY, NY (1994).*

McCutcheon's vol. 1: Emulsifiers & Detergents North American Edition 1993 (McCutcheon Division, MC Publishing Co., Glen Rock NJ, USA, copyright 1993) pp. 237-246, Jan. 1994.*

Emulsions Fundamentals and Applications in the petroleum industry, edited by Schramm, Advanced Chemistry Series, ACS, Wash, DC, (Aug. 1993), pp. 38-41.*

Tolen; Burst of Advances Enhance Cat Cracking; Oil & Gas Journal, OGI Report; Mar. 30, 1981; pp. 90-107.

Johnson, et al.; Third Generation FCC Feed Injection Technology: Introduction of the Atomax™ Feed Nozzle; 1994 NPRA Annual Meeting, Mar. 20-22, 1994, Convention Center, San Antonio, Texas; AM-94-55.

Miller, et al; New Developments in FCC Feed Injection and Stripping Technologies; NPRA 2000 Annual Meeting, Mar. 26-28, 2000, Convention Center, San Antonio, Texas; AM-00-08.

Dezhi, et al; Application of"Demolition Atomization" Theory in Atomization of Feedstock for RFCCU; Lianyou Sheji, 2001 31(11); pp. 19-21, (Petroleum Refinery Engineering-original and attached translation.

Yang et al.; Effect of Emulsified Stock on Product Distribution of FCC:, Abstract 75 from American Chemical Society Division of Industrial & Engineering Chemistry, 223rd ACS National Meeting, Orlando FL (Apr. 7-11, 2002).

* cited by examiner

FIGURE
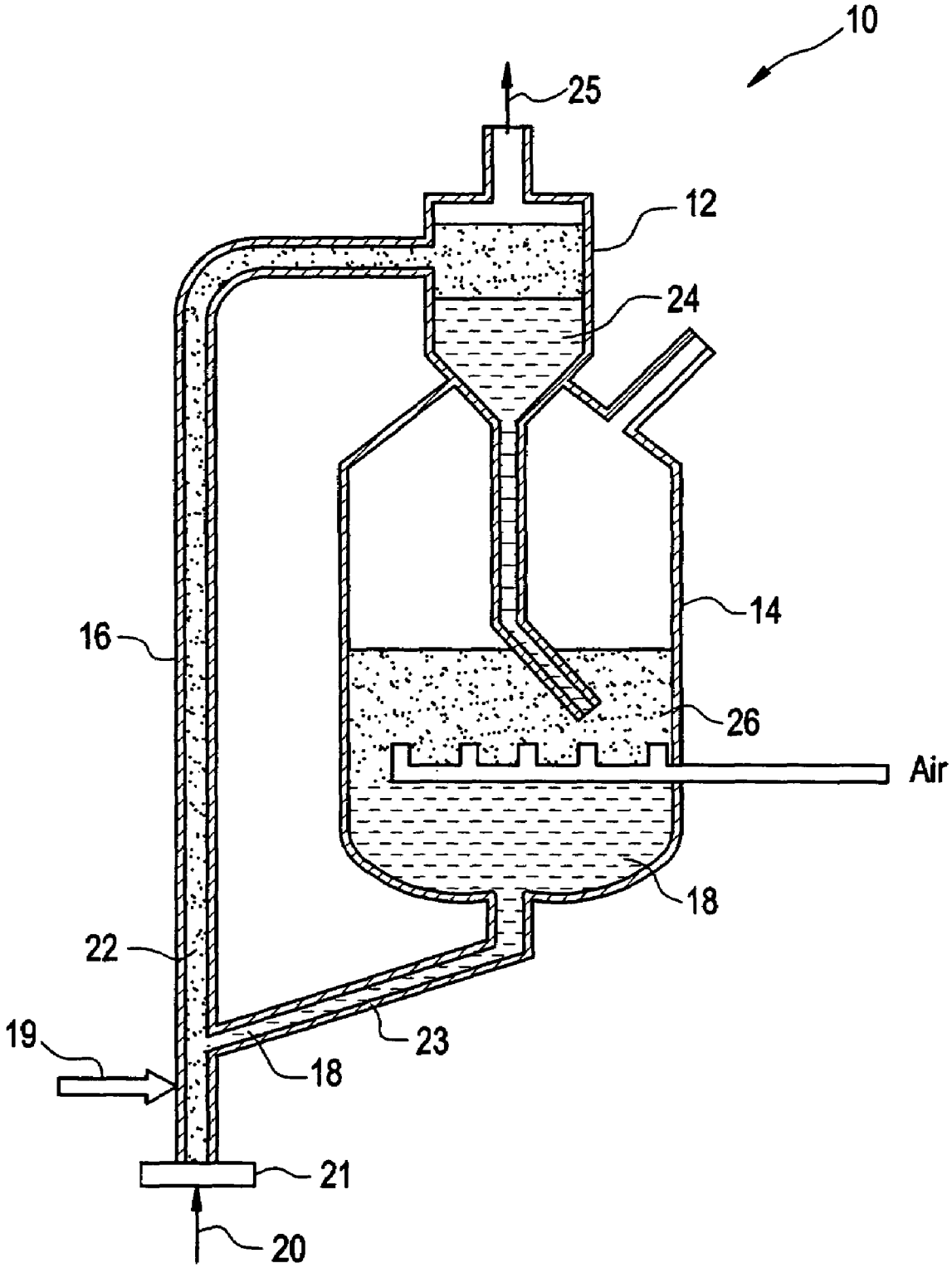

SPRAY ATOMIZATION

FIELD OF THE INVENTION

The invention relates to a hydrocarbon feedstock composition suitable to be handled in a pressure-type atomizer. In particular, the invention relates to a feedstock composition for improving atomization in hydrocarbon processing that includes an emulsified water-in-hydrocarbon oil emulsion.

BACKGROUND OF THE INVENTION

Catalytic cracking involves the processing of gas oils using catalysts to crack the carbon-carbon bonds. In particular, catalytic cracking consists of breaking saturated C12+molecules into C2-C4 olefins and paraffins, gasoline, light oil, and coke. Cracking serves to lower the average molecular weight and to produce higher yields of fuel products. The majority of the reactions are endothermic and heat must be supplied to the cracking process. Cracking can be either purely thermal or thermal and catalytic. In general, it is desirable to promote catalytic cracking over thermal cracking since thermal cracking produces unwanted by-products.

The FIGURE is a diagram of a typical fluidized catalytic cracking (FCC) unit 10. In particular, these units include a riser reactor 16, which acts as a plug flow reactor where catalytic cracking occurs at operating temperatures of about 950-1000° F.; and a catalyst regenerator 14 which serves to remove the excess carbon laid down on the catalyst as coke that is produced by the cracking reactions. In the riser reactor 16, hot regenerated catalyst 18 from the catalyst regenerator is diluted with steam 19 and a preheated feed composition (typically at 300° F. or greater) 20 is injected through a spray nozzle 21 just above the bottom of the riser reactor. Catalyst flow is controlled by valves and changing the density in the standpipe 23 with steam 19. Regenerated catalyst 18 flows down through standpipe 23 from the regenerator to be lifted to the reactor 16 by steam 19 and fresh feed 20. The dilute phase of the catalyst 22 flows up the riser at temperatures of about 750° F. and discharges the hot reactants into the upper part of the riser reactor 16. Reacted hydrocarbon vapors are then separated from the dense phase of the spent catalyst 24. In particular, the reacted hydrocarbon vapors are purified by passing through cyclone separators 12 to reduce particulate content and the separated vapors, which constitute the catalytic products 25, are sent to a fractionator. The catalyst with coked surface drops to the regenerator 14 where it is present as a dilute phase 26. In the regenerator 14, the coke is burnt off at temperatures of about 1200°-1300° F., and a dense phase of regenerated catalyst 18 is returned for another reaction pass.

It is known that feed atomization in the base of the FCC riser reactor is a problem in hydrocarbon processing. In particular, it is difficult to contact many tons per hour of hot, regenerated cracking catalyst with large volumes of heavy oil feed, while ensuring the complete vaporization of the feeds at the bottom of the riser reactor. Part of this problem can be attributed to the use of heavier feeds in FCC units. In particular, heavier feeds are more difficult to vaporize because of their high boiling points, and the heavy feeds are harder to atomize because of their high viscosity, even at the high temperatures which exist in FCC riser reactors.

Effective operation of several process units in hydrocarbon processing depend on the ability to atomize the hydrocarbon stream. The preferred reaction in a catalytic cracker occurs within the pores of the catalyst. This requires vaporization of the feed. At a fixed reactor temperature, the kinetics of vaporization are largely determined by the size of droplets introduced into the reactor. In particular, for a fluid catalytic cracker, a fluidized bed of catalyst is sprayed with hydrocarbon at the bottom of the riser reactor. The creation of small hydrocarbon droplets in the spray is a key contributor to unit efficiency as it promotes catalytic cracking over thermal cracking. A feed injection system should provide both rapid vaporization and intimate contact between the oil and catalyst. Rapid vaporization requires atomization of the feedstock into small droplets with narrow size distribution.

Efficient atomization for these hydrocarbon processes has been the focus of numerous mechanical process changes. For example, the mechanical improvements include refinements such as inclusion of internal barriers in the fluid catalytic cracker, impingement blocks and improved methods of spray blast. All of these approaches rely on enhancing various factors known to be important in spray atomization. Another approach has been to introduce an alternate mechanism of atomization. Generally, this is referred to as secondary atomization. Primary atomization relies on the balance between the cohesive nature of the fluid being sprayed and the aerodynamic forces impinging on a drop that drives breakup. However, in secondary atomization a second factor is introduced that induces droplet breakup.

Secondary atomization as a means of improving combustion processes is well established. For example, U.S. Pat. No. 3,672,853 describes a process for the preparation of a liquid fuel suitable to be handled in a pressure-type atomizer, using a hydrocarbon-containing feed as base material, in which process a gas is dissolved in the feed and improves atomization of the fuel. As the result of the pressure in the pressure-type atomizer decreasing very rapidly, the solubility of the gas also decreases. Gas thus being liberated contributes to the liquid droplets being split up to a larger extent.

U.S. Pat. No. 6,368,367 discloses an aqueous diesel fuel composition for internal combustion engines that includes a continuous phase of diesel fuel; a discontinuous aqueous phase that is comprised of aqueous droplets having a mean diameter of 1.0 micron or less; and an emulsifying amount of an emulsifier composition including an ionic or non-ionic compound having a hydrophilic lipophilic balance (HLB) in the range of about 1 to about 10.

Whereas secondary atomization as a means of improving combustion processes is well established, there has been little, if any, effective transfer of this technology to the hydrocarbon process field.

An article in *Oil and Gas Journal*, Mar. 30, 1991, pp 90-107 describes a means of mixing steam to the feed of a fluid catalytic cracker by feeding an emulsified fuel that separates into a two-phase (i.e. water vapor and liquid oil) flow prior to the spray nozzle at the bottom of the riser reactor. This two-phase approach provides for extra energy of mixing, meaning that the oil and catalyst mix faster, providing less opportunity for the oil to thermally crack. However, this two-phase approach does not affect the transport properties of the hydrocarbon feed. Moreover, because it is a two-phase flow on the feed side of the spray nozzle, there is no phase change across the nozzle to increase atomization efficiency.

An article in *Petroleum Refinery Engineering*, vol. 31 (11) pp. 19-21, 2001 discloses the use of surfactants to stabilize a water-in-oil emulsion. In particular, a feedstock for heavy oil catalytic cracking is disclosed as being emulsified and formed into a stable water-in-oil emulsion by a non-ion surfactant compound. The water is dispersed uniformly in oil with drops of about 5 microns. In particular, the emulsified feedstock is first atomized by pumping through an atomization nozzle. After subsequently being in contact with high temperature catalyst, the water drops rapidly vaporize, causing the effect of secondary atomization whereby the oil drops break into smaller drops, which are easier to get into the reaction channel of the catalyst. The yield of light oil is reported to have been enhanced and the yields of dry gas and coke decreased, whereas product qualities of diesel and gasoline remain unchanged. The nature of the surfactant is not disclosed, except that it is a blend of materials with an HLB of 5.8. According to data obtained from surfactant formulatory indices, surfactants with HLB's in this range are reported to stabilize water-in-oil emulsions. The emulsified feedstock in this reference was tested in a pilot plant, under operating conditions very different than those encountered in working plants. For example, the reference discloses the use of emulsified feedstock temperatures of about 85-90° C. Under the relevant temperature and pressure conditions encountered at working hydrocarbon processing plants, non-ionic surfactants with an HLB of 5.8 do not stabilize water-in-oil emulsions, as discovered by the present inventors.

It would be advantageous, therefore, to provide a feedstock composition for use in hydrocarbon process units, where a water-in-oil emulsion of small droplet size could be formed and stabilized under conditions typically encountered under process (or modified process) conditions. In particular, it would be advantageous to provide a water-in-oil emulsion with improved atomization properties that would be stable under the conditions relevant for FCC systems. Such conditions would include elevated temperature (greater than 300° F.) and elevated pressure conditions (pressure greater than steam vapor pressure) at the working temperature.

SUMMARY OF THE INVENTION

The present invention provides a feedstock composition for increasing the efficiency of atomization in hydrocarbon processing. In particular, the present invention provides a water-in-hydrocarbon oil emulsion including a non-ionic surfactant capable of stabilizing the emulsion and having a hydrophilic-lipophilic balance of greater than about 12.

Further provided is a process for preparing a feedstock emulsion composition with increased efficiency of atomization that includes the steps of: (a) providing a water source; (b) providing a hydrocarbon fuel oil source; (c) providing a non-ionic surfactant having a hydrophilic-lipophilic balance of greater than about 12; and (d) combining components (a), (b) and (c) under conditions sufficient to form a water-in-hydrocarbon fuel oil emulsion, the non-ionic surfactant being present in an amount suitable to stabilize the emulsion.

Moreover, the present invention provides a process for controlling atomization of a liquid hydrocarbon comprising the steps of: (a) providing a water source; (b) providing a hydrocarbon fuel oil source; (c) providing a non-ionic surfactant having a hydrophilic/lipophilic balance of greater than about 12; and (d) combining components (a), (b) and (c) on the feed side of a spray nozzle; and (e) passing said combined components through said spray nozzle to produce a controlled hydrocarbon droplet size and distribution.

BRIEF DESCRIPTION OF THE DRAWINGS

The FIGURE is a schematic showing of a fluid catalytic cracking unit (FCCU).

DETAILED WRITTEN DESCRIPTION

As described above, catalytic cracking is a process which consists of breaking saturated C12+molecules into C2-C4 olefins and paraffins, gasoline, light oil, and coke. The primary goal of catalytic cracking is to make gasoline and diesel and to minimize the production of heavy fuel oil, gas and coke. The basic reaction involved in catalytic cracking is the carbon-carbon scission of paraffins, cycloparaffins and aromatics to form olefins and lower molecular weight paraffins, cycloparaffins and aromatics.

As described above, a fluidized catalytic cracking process is a process wherein a hydrocarbon feed composition is catalytically cracked in a riser reactor to produce cracked products and spent catalyst. The spent catalyst is stripped of oil and regenerated in a catalyst regenerator to produce hot regenerated catalyst, which is subsequently recycled to the riser reactor. The FCC unit includes an atomizing feed nozzle to inject feed at the bottom portion of the riser reactor. The flowing stream containing liquid hydrocarbon is atomized by passing from the feed side of the nozzle to the catalyst side. This type of primary atomization relies on the balance between the cohesive nature of the fluid being sprayed and the aerodynamic forces impinging on a drop that drives breakup.

Under typical hydrocarbon processing conditions, the feed composition is passed under pressure (usually less than steam vapor pressure) to an atomizer, which results in the formation of minute droplets of liquid which leave the atomizer to come in contact with a catalyst. The reduction in large hydrocarbon droplets is important because the large droplets are slow to vaporize and reduce the availability of the catalyst sites to the fuel. Therefore, by reducing the number of large droplets, FCC unit conversion (i.e. the production of gasoline and diesel) increases. Moreover, it is known that increasing reactor temperature increases conversion. Heat to the reactor is controlled by catalyst circulation rate, regenerated catalyst temperature, and feed preheat. In general, the temperature of the feed is at least about 300° F.-400° F. at the bottom of the reactor.

The present invention provides a feed composition that improves atomization under elevated temperature conditions in hydrocarbon processing through the introduction of a surfactant that induces deposit breakup. In particular, the invention relates to a feed composition suitable to be handled in a pressure-type atomizer, the composition including a water-in-oil emulsion including a surfactant having an HLB of greater than about 12. It has been found that the surfactant has a favorable effect on the atomization of the feed composition. In particular, the surfactant serves to stabilize the emulsion under the elevated temperature and pressure conditions encountered in hydrocarbon processing plants. In particular, water drops are evenly dispersed in the oil phase and are about 5 to about 10 microns in diameter. The high pressure on the feed side of the atomizer nozzle maintains the water as liquid drops in the oil phase. The emulsified feedstock first becomes atomized by pumping through the atomization nozzle where aerodynamic forces impinge on a drop that drives breakup. As a result of the pressure decreasing very rapidly across the atomizer nozzle, gas is liberated, which contributes to the hydrocarbon oil droplets being split up. The emulsified feedstock is subsequently contacted with high temperature regenerated catalyst after the nozzle. As the emulsified feedstock is being heated by the catalyst at the bottom of the riser reactor, the water vaporizes first due to its lower boiling point as compared with oil, and its volume expands rapidly. As a consequence, in a short period of time oil droplets are split up to an even larger extent, this process being called secondary atomization. Forcing the oil drops to break into much smaller drops improves their ability to get into the reaction channel of the catalyst. In general, because the reaction contact surface area is increased, the catalytic cracking reaction is also increased.

Secondary atomization introduces a second factor that induces droplet breakup. The present invention provides a means of generating metastable water-in-oil emulsions that explode under spray conditions where the system pressure is released. Key characteristics of the inventive emulsion are the uniform distribution of small (5-10 microns) water droplets in the oil at disperse phase concentration that are large enough that the expansion work done by the exploding droplets is sufficient to overcome the cohesive energy of the hydrocarbon. The expanding gas explodes, demolishing a larger droplet and producing smaller droplets. As described above, secondary atomization as a means of improving combustion processes is well established, but there has been little, if any, effective transfer of this technology to the process fields. For hydrocarbon process units, the important criteria is that a homogenous water-in-oil emulsion of small droplet size be formed and stabilized under process (or modified process) conditions. This is a significant restriction compared to the combustion system, where typically the temperatures are lower.

The present invention provides metastable homogeneous oil-in-water emulsions with small droplet size under the elevated temperature conditions typical of hydrocarbon process units, particularly fluid catalytic crackers. In particular, the invention provides a feedstock composition for increasing the efficiency of atomization in hydrocarbon processing that includes a water-in-hydrocarbon oil emulsion comprising a non-ionic surfactant capable of stabilizing the emulsion and having a hydrophilic-lipophilic balance of greater than about 12.

In one embodiment, the water in the composition is present in amounts of about 1 to about 15% by volume of the total composition. In a further embodiment, the hydrocarbon oil is present in amounts of about 84 to about 99% by volume of the total composition. In another embodiment, the surfactant is present in amounts of about 10 ppm. Preferably, the surfactant is present at about 500 ppm to 1% by volume of the total composition, and the water concentration is 3%-6% of the total charge.

The hydrocarbon feed source is desirably selected from the following: gasoils, vacuum gasoils, tower bottoms (also known as resid) hydrotreated feeds, wax, solvent raffinates, coker gasoil, visbreaker gasoil, lube extracts and deasphalted oils. These feedstocks are used both alone and as blends.

Desirably, the non-ionic surfactant is selected from one of the following: exthoxylated alkyl phenols (e.g. nonyl phenol ethoxylate, octyl phenol ethoxylate), ethylene oxido propylene oxide block copolymers (EOPO block copolymers), polymerized alcohols and amines (e.g. polyvinyl alcohol), and partially fluorinated chain hydrocarbons. Additional examples of useful non-ionic compounds are disclosed in McCutcheon's Emulsifiers and Detergents, 1998, North American and International Edition.

In preferred embodiments, the hydrophilic-lipophilic balance of the non-ionic surfactant is about 15 to about 16. The surfactant in the present invention acts as an emulsifier that prevents the separation of emulsions. Emulsions are two immiscible substances, one present in droplet form contained within the other. In the present invention, the emulsion consists of water-in-oil where the liquid water becomes the dispersed phase and the continuous phase is the hydrocarbon oil. The discontinuous aqueous phase comprises liquid water droplets of about 5-10 microns in diameter. These drops are dispersed substantially uniformly in the hydrocarbon oil phase.

A suitable surfactant has a polar group with an affinity for water (hydrophilic) and a non-polar group which is attracted to oil (lipophilic). While not wishing to be bound by any one theory, it is believed that the surfactant is absorbed at the interface of the two substances (i.e. oil and water), providing an interfacial film acting to stabilize the emulsion in that it contributes to the uniformity or consistency of the feedstock under the high temperature and pressure conditions relevant for hydrocarbon processing. In particular, the non-ionic surfactant having an HLB value of greater than about 12 stabilizes the emulsion at temperatures of about 200-300° F. and steam vapor pressure.

The hydrophilic/lipophilic properties of emulsifiers are affected by the structure of the molecule. These properties are identified by the hydrophilic/lipophilic balance (HLB) value, which is defined below, wherein S is the saponification number and A is the acid number. HLB values are determined at room temperature by methods well known in the art.

$$HLB=20(1-S/A)$$

Conventional wisdom within the formulatory community has held that low HLB values (4-6) indicate greater lipophilic tendencies which have been previously used to stabilize water-in-oil emulsions and that high HLB values (8-18) are assigned to hydrophilic emulsifiers, typically used in oil-in-water emulsions (see Example below). In contrast, the present inventors have discovered that under the conditions relevant for hydrocarbon processing, emulsifiers with high HLB values (greater than about 12) are useful for stabilizing water-in-oil emulsions. This finding was both surprising and unexpected.

In general, the emulsions of the present invention require shear to ensure proper dispersal of the stabilizer (i.e. the non-ionic surfactant). For example, mechanical shear can be used to form a homogeneous mixture of the water, hydrocarbon oil and non-ionic surfactant having an HLB of greater than about 12. Moreover, shear can reduce the viscosity of the feed composition before the atomization nozzle in an FCC unit, which improves atomization.

In addition to the foregoing components of the inventive feedstock composition, other additives which are well known to those of skill in the art can be used. For example, these can include cationic and anionic surfactants, diluents and other high vapor pressure components, such as alcohols.

It is noted that fluid catalytic crackers present other limitations on additive practice in that many heteroatom species should be avoided, so that catalytic poisoning is minimized, and care should be taken to minimize corrosive species. For example, the major active component of an FCC catalyst is a type Y zeolite. The zeolite is dispersed in a relative inactive matrix to moderate the zeolite activity. Zeolites are crystalline alumino-silicate frameworks comprising $[SiO_4]^{4-}$ and $[AlO_4]^{5-}$ tetrahedral units.

As described in further detail below, several components typical of ionic surfactants are known to cause catalyst poisoning or corrosion. For example, nitrogen, halogens, especially chlorine and fluorine, and sodium are catalyst poisons which are components of many ionic surfactants. In particular, sodium is a common and severe poison for the cracking catalyst, and no method is known which can remove the sodium and retain the catalytic properties of the catalyst in which the refiners ability to crack resides. In contrast, the non-ionic surfactants useful for forming the water-in-oil emulsions of the present invention are benign in that corrosive and poisoning effects on the catalyst are minimal. Increasing catalyst activity by eliminating poisoning effects of such species increases conversion (i.e. the production of gasoline and diesel products). Thus, the use of non-ionic surfactants has considerable advantages over the use of ionic surfactants in hydrocarbon processing.

The present invention further relates to a process for preparing a feedstock emulsion composition with increased efficiency of atomization that includes the following steps: (a) providing a water source; (b) providing a hydrocarbon fuel oil source; (c) providing a non-ionic surfactant having a hydrophilic-lipophilic balance of greater than about 12; and (d) combining these aforementioned components under conditions sufficient to form a water-in-hydrocarbon fuel oil emulsion, the non-ionic surfactant being present in an amount suitable to stabilize the emulsion.

The water, hydrocarbon fuel oil, and non-ionic surfactant are preferably mixed on the feed size of a spray nozzle. In one embodiment, these components are combined under emulsification conditions comprising temperatures of greater than about 200-300° F. Moreover, these components are desirably combined under pressure conditions of greater than about steam vapor pressure. This serves to maintain the water in liquid form on the feed side of a spray nozzle. In one embodiment, the components of the emulsion are combined by first mixing a non-ionic surfactant having an HLB of greater than about 12 with the water source to form a surfactant liquid, and subsequently mixing the surfactant liquid with the hydrocarbon fuel oil source to form the emulsion.

For example, in a FCC unit, passing the emulsion from the feed size of the spray nozzle to the catalyst side, where it is contacted by hot regenerated catalyst, produces a controlled hydrocarbon droplet size and distribution which increases catalytic conversion. Preferably, the oil comes into the FCC riser reactor as a flowing liquid phase before the spray nozzle. Furthermore, liquid water containing the surfactant is desirably admitted transversely into the flowing hydrocarbon fluid through an inlet of a separate line, the inlet being located before the spray nozzle. The combined components are mixed by being subjected to a mechanical shear force (e.g. blender blades), to form the stable emulsion under temperatures of about 200-300° F. and about steam vapor pressure or greater. Following mixing, the stabilized emulsion is subjected to an initial atomization as it passes through the spray nozzle due to the low pressure drop through the nozzle. After being in contact with high temperature regenerated catalyst on the catalyst side of the spray nozzle, the water drops vaporize and their volume expands rapidly. This process of secondary atomization forms even smaller hydrocarbon oil droplets in the riser, which can promote catalyst conversion.

EXAMPLES

Example 1

Determining the Efficacy of Surfactants to Stabilize Water-In-Oil Emulsions

An experimental vessel was constructed in order test the ability of various surfactants to stabilize water-in-oil emulsions. The experimental vessel was of a pipe construction that allowed the experiment to be conducted under appropriate temperature and pressure conditions that reproduced those typically encountered in hydrocarbon processing. The experimental vessel was equipped with a base that included a blender blade for generating emulsions, and with feed-throughs on the top that allowed for removal of aliquots of process fluid for microscopic examination. The fluid shears experienced in the atomization nozzle were simulated by the turbulence created by the blender blades. A speed-controlled motor system was used to control this turbulence. The top of the sample vessel included a provision for a pressure transducer, an internal temperature transducer, and a dip tube system which allowed for removal of a sample aliquot without quenching the entire system.

Comparative tests were run in the aforementioned pipe vessel using emulsified feedstock compositions including various surfactants. Table 1 below provides an illustrated example of the feedstock compositions tested.

TABLE 1

| Components | Parts By Weight |
|---|---|
| Hydrocarbon fuel oil | 84-94% |
| Deionized water | 5-15% |
| Surfactant | 10 ppm-1% |
| Low molecular Weight alcohols | 0-5% |

Table 2 below provides a list of the surfactants tested, and their characteristics, including their HLB rating.

TABLE 2

| Surfactant Chemical class | Type | HLB Range tested |
|---|---|---|
| Nonyl Phenol ethoxylate | nonionic | 7-16 |
| Ethylene oxide propylene oxide block copolymers | nonionic | 1-28 |
| Cetyltrimethylammonium bromide | cationic | 6.1 |
| polyoxyethylene thioether | nonionic | 12.1 |
| dioctyl ester of sulfosuccinic acid | anionic | 10.4 |

With reference to Table 2 above, cationic surfactants possess a net positive charge, and were based on quaternary nitrogen-containing compounds. Anionic surfactants possess a net negative charge and were either sodium salts of long-chain fatty acids with carboxylic acid groups (soaps), or long-chain hydrocarbons with a sulfate or phosphate group (detergents). Non-ionic surfactants have no electrical charge and were polyethoxylates formed from the reaction of long-chain hydrocarbon alcohols or carboxylic acids with ethylene oxide.

After hydrocarbon fuel oil feedstock for catalytic cracking was mixed with water containing the surfactant being tested, the combined effect of the surfactant and shear force was assessed qualitatively. In particular, the efficacy of surfactants was assessed at elevated temperature (from 200-300° F.) and elevated pressure (greater than steam vapor pressure at the working temperature) conditions. Generally speaking, in the absence of special conditions or surfactants, water-in-oil emulsions are unstable. Practically, this means that small droplets coalesce to form larger droplets. Uniform dispersion of the water drops in the oil was used as a prime indicator that the water-in-oil emulsion was stabilized by the surfactant tested. As used herein, the test of stability was to examine a fluid removed from the test vessel to see that the droplet distribution is "uniform". Large water droplets in the sample indicated that the surfactant was ineffective in stabilizing the emulsion.

The temperature of the feedstock composition tested in Table 1 above was initially at room temperature (approximately 70° F.), and increased to 300° F. during mixing. The experimental vessel was pressurized with nitrogen so that the working pressure was greater than steam vapor pressure during mixing. The ultimate temperature of the vessel was only 300° F. so the experimental vessel was initially pressurized to 50 psig, the vapor pressure of steam at that temperature. After 10 minutes of sample shear, the vessel was quickly cooled, and a sample of the emulsion was removed and then analyzed for droplet size of the aqueous phase by microscopic examination.

Results indicated that under the conditions relevant for FCC systems, non-ionic surfactants with a tabulated HLB of greater than about 12 are effective agents for stabilization of water-in-oil emulsions. In particular, the present inventors have found that non-ionic surfactants with a tabulated HLB of approximately 15-16 are particularly effective agents for stabilization of water-in-oil emulsions. This is in contrast to the conventional wisdom within the formulatory community which holds that surfactants with an HLB in a lower range (4-6) should stabilize water-in-oil emulsions and that surfactants with higher HLB(s) (8-18) should stabilize oil-in-water emulsions. Such prior art knowledge within the formulatory community is summarized in Comparative Table 3 below.

COMPARATIVE TABLE 3

| HLB | Non-Ionic Surfactant Characteristics |
|---|---|
| 4-6 | water-in-oil emulsifiers |
| 7-9 | good wetting agents |
| 8-18 | oil-in-water emulsifiers |

The results obtained by the present inventors also indicated that non-ionic surfactants having a HLB of approximately 15-16 results in water droplets of about 5 to about 10 microns in diameter, the droplets being dispersed substantially uniformly in the hydrocarbon oil phase. However, it is noted that the size and distribution of the water droplets in the hydrocarbon oil phase can vary depending on the experimental conditions. For example, if the hydrocarbon-water-surfactant ratios were changed, or the amount of shear were changed, the size and distribution of drop sizes would likely change.

The inventors have further determined that non-ionic surfactants, in contrast to cationic or anionic surfactants, are benign in that corrosive and poisoning effects on the catalyst are minimal. In particular, the non-ionic surfactants contain benign heteroatoms. It is known, for example, that halogens, especially chlorine and fluorine, which can be present in ionic surfactants, are quite serious catalyst poisons and that they cause high dry-gas makes, probably by formation of metal halides with metals on the catalyst. Moreover, a common and severe poison for the cracking catalyst is sodium, which is a component of many ionic surfactants. For example, many anionic surfactants are sodium salts of long-chain fatty acids with carboxylic acid groups (soaps), as noted above. Sodium quantitatively poisons the zeolite catalyst by combining with it and destroying the sieve structure. In particular, when the sodium on the equilibrium catalyst exceeds 1.0%, the catalyst will usually be so deactivated as to be useless. In addition, nitrogen is a temporary catalyst poison that causes a decrease in catalytic activity, and cationic surfactants are largely based on quaternary nitrogen-containing compounds, as mentioned above. The feedstock composition of the present invention is advantageous in that it does not include the aforementioned corrosive and poisoning components, which are often present in ionic surfactants, and which lead to deactivation of the catalyst.

Furthermore, feedstock compositions of the present invention including non-ionic surfactants having an HLB of greater than about 12 would likely enhance the yield of light oil and gasoline and decrease the yield for coke and gases.

What is claimed is:

1. A process for preparing a feedstock emulsion composition with increased efficiency of atomization comprising the steps of:

(a) providing a water source;

(b) providing a hydrocarbon oil source;

(c) providing a non-ionic surfactant having a hydrophilic-lipophilic balance of greater than about 12, said surfactant being selected from the group consisting of ethoxylated alkyl phenols, ethylene oxide propylene oxide block copolymers, polymerized alcohols and amines, and combinations thereof, and (d) combining components (a), (b) and (c), wherein said combining comprises mixing components (a), (b) and (c) on the feed side of a spray nozzle under temperatures of greater than about 200-500° F. and under pressure conditions greater than steam vapor pressure to form a stabilized water-in-hydrocarbon oil simple emulsion comprising a hydrocarbon oil phase for use in fluidized catalytic cracking, said non-ionic surfactant being present in an amount suitable to stabilize said emulsion; wherein said emulsion comprises water droplets dispersed substantially uniformly in said hydrocarbon oil phase.

2. The process of claim 1, wherein said combining comprises first mixing said surfactant with said water to form a surfactant liquid, and subsequently mixing said surfactant liquid with said hydrocarbon oil to form said emulsion.

3. The process of claim 1, wherein components (a), (b) and (c) are combined on the feed side of a spray nozzle and subsequently passed through said spray nozzle, whereby a controlled hydrocarbon droplet size and distribution is produced.

4. The process of claim 1, wherein said hydrophilic-lipophilic balance of the non-ionic surfactant is about 15 to about 16.

5. The process of claim 1, wherein said water droplets are of about 5 to about 10 microns in diameter.

6. The process of claim 1, wherein the water is present in amounts of about 3 to about 15% by volume of the total feedstock emulsion composition.

7. The process of claim 1, wherein the hydrocarbon oil is present in amounts of about 84 to about 97% by volume of the total feedstock emulsion composition.

8. The process of claim 1, wherein the non-ionic surfactant is present in amounts of about 10 ppm-1% by weight of the total feedstock emulsion composition.

9. The process of claim 1, wherein the non-ionic surfactant is present in amounts of about 500 ppm-1% by volume of the total feedstock emulsion composition.

* * * * *